US007909061B2

(12) United States Patent
Nelson

(10) Patent No.: US 7,909,061 B2
(45) Date of Patent: Mar. 22, 2011

(54) MAGNETIC COUPLING FOR SPRAYHEADS

(75) Inventor: Alfred Charles Nelson, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 488 days.

(21) Appl. No.: 11/393,450

(22) Filed: Mar. 30, 2006

(65) Prior Publication Data

US 2006/0283511 A1 Dec. 21, 2006

Related U.S. Application Data

(60) Provisional application No. 60/691,389, filed on Jun. 17, 2005.

(51) Int. Cl.
*F16K 21/00* (2006.01)

(52) U.S. Cl. ..... 137/801

(58) Field of Classification Search ..... 137/801; 4/675–678

See application file for complete search history.

(56) References Cited

U.S. PATENT DOCUMENTS

| | | | | |
|---|---|---|---|---|
| 3,181,895 | A * | 5/1965 | Cator | 285/1 |
| 3,265,075 | A | 8/1966 | Edman et al. | |
| 4,205,678 | A | 6/1980 | Adair | |
| 4,232,695 | A | 11/1980 | Roberge | |
| 4,304,256 | A | 12/1981 | Taiani | |
| 4,384,703 | A | 5/1983 | Ruyak et al. | |
| 4,427,960 | A | 1/1984 | Wuerfel | |
| 4,651,720 | A | 3/1987 | Baus | |
| 4,718,131 | A | 1/1988 | Kitamura et al. | |
| 5,096,230 | A | 3/1992 | Pausch et al. | |
| 5,277,391 | A | 1/1994 | Haug et al. | |
| 5,419,354 | A * | 5/1995 | Krynicki | 137/1 |
| 5,645,302 | A * | 7/1997 | Horimoto | 285/70 |
| 5,727,769 | A | 3/1998 | Suzuki | |
| 5,771,934 | A | 6/1998 | Warshawsky | |
| 6,023,951 | A | 2/2000 | Maurer et al. | |
| 6,387,096 | B1 | 5/2002 | Hyde | |
| 6,446,278 | B1 | 9/2002 | Lin | |
| 6,757,921 | B2 | 7/2004 | Esche | |
| 6,786,239 | B1 | 9/2004 | Welsh | |
| 6,845,526 | B2 | 1/2005 | Malek et al. | |
| 6,877,172 | B2 | 4/2005 | Malek et al. | |
| 6,910,604 | B2 | 6/2005 | Gugliotti et al. | |
| 6,938,837 | B2 | 9/2005 | Nelson et al. | |
| 7,114,510 | B2 | 10/2006 | Peters et al. | |
| 7,246,757 | B2 * | 7/2007 | Juo | 239/353 |
| 7,252,112 | B1 | 8/2007 | Imler et al. | |
| 7,520,105 | B2 | 4/2009 | Geller | |
| 2003/0041372 | A1 | 3/2003 | Yang | |

(Continued)

FOREIGN PATENT DOCUMENTS

| | | |
|---|---|---|
| DE | 1 489 255 | 8/1969 |

(Continued)

OTHER PUBLICATIONS

Grohe Product Catalog pages, Stainless Steel pull-out spray, 33 755, 2004, 4 pages.

(Continued)

*Primary Examiner* — Craig M Schneider
(74) *Attorney, Agent, or Firm* — Baker & Daniels LLP

(57) ABSTRACT

A faucet including a faucet head, a body and a magnetic coupling releasably coupling the faucet head to the faucet body.

35 Claims, 17 Drawing Sheets

U.S. PATENT DOCUMENTS

| | | | | |
|---|---|---|---|---|
| 2003/0188381 | A1* | 10/2003 | Bosio | 4/675 |
| 2004/0010848 | A1 | 1/2004 | Esche | |
| 2004/0135009 | A1 | 7/2004 | Malek et al. | |
| 2004/0177880 | A1 | 9/2004 | Nelson | |
| 2004/0254533 | A1* | 12/2004 | Schriver et al. | 604/131 |
| 2006/0130907 | A1 | 6/2006 | Marty et al. | |
| 2006/0283511 | A1 | 12/2006 | Nelson | |
| 2007/0001018 | A1 | 1/2007 | Schmitt et al. | |
| 2007/0170284 | A1 | 9/2007 | Nelson | |
| 2009/0007330 | A1 | 1/2009 | Genord et al. | |
| 2009/0302181 | A1 | 12/2009 | Glunk | |
| 2010/0170587 | A1 | 7/2010 | Kaess | |

FOREIGN PATENT DOCUMENTS

| | | |
|---|---|---|
| DE | 40 00 621 | 7/1991 |
| DE | 196 49 006 | 5/1998 |
| DE | 201 17 761 U1 | 3/2002 |
| DE | 102 60 207 | 6/2004 |
| EP | 0 091 032 | 10/1983 |
| EP | 1 350 895 | 10/2003 |
| EP | 1 367 183 | 12/2003 |
| EP | 2 042 663 | 4/2009 |
| FR | 2197395 | 3/1974 |
| GB | 2 285 919 | 8/1995 |
| GB | 2 431 861 | 5/2007 |
| JP | 2000-263060 | 9/2000 |
| JP | 2002-068270 | 3/2002 |
| JP | 2002-223969 | 8/2002 |
| NL | 1028853 | 10/2006 |
| WO | WO 2005/026457 | 3/2005 |
| WO | WO 2008/107101 | 9/2008 |
| WO | WO 2008/107102 | 9/2008 |
| WO | WO 2008/107103 | 9/2008 |
| WO | WO 2010/021765 | 2/2010 |

OTHER PUBLICATIONS

Supplementary European Search Report for European Application No. EP 06772392.4, issued Sep. 6, 2010, 14 pgs. (including PCT International Search Report and Written Opinion for International Application No. PCT/US2006/22061, issued Jan. 2, 2008).

* cited by examiner

MAGNETIC COUPLING FOR SPRAYHEADS

CROSS-REFERENCE TO RELATED APPLICATION

This application claims the benefit of U.S. Provisional Application Ser. No. 60/691,389, filed Jun. 17, 2005, the disclosure of which is expressly incorporated by reference herein.

BACKGROUND AND SUMMARY OF THE INVENTION

The present invention relates to faucets having pullout sprayheads and, more particularly, to improvements in the manner by which the sprayhead is coupled and/or uncoupled from the faucet body.

Faucets having sprayheads that pull out from the faucet body enable users to manipulate the sprayhead independent of the faucet body and to aim the water spray directly at a target, instead of requiring the user to place the target under the sprayhead. Such prior art faucets typically utilize locking bayonet connectors, or connectors comprising collars and snap fingers to produce a retaining force to couple the sprayhead to the faucet body. Unfortunately, some of these prior art connectors may degrade with use. Particularly in the case of connectors formed of collars and resilient snap fingers, the retaining force often decreases with continual use. Further, the retaining force of such prior art connectors may be too great for some users to overcome, in which case the user would find it difficult to uncouple the sprayhead from the holder.

Accordingly, there is a need for a faucet having a sprayhead with a durable coupling that enables users to easily couple and uncouple the sprayhead from its holder.

The present invention generally provides a faucet having an improved coupling for use in coupling and uncoupling a pullout sprayhead from the body of the faucet. In one illustrative embodiment, the faucet includes a faucet head, a faucet body and a magnetic coupling releasably coupling the faucet head to the faucet body. In one aspect of this embodiment, the magnetic coupling may include a magnet disposed on either one of the faucet head and the faucet body, and a magnetically attractive material disposed on the other of the faucet head and the faucet body. The magnetically attractive material may include iron, steel or mixture thereof. In addition, the magnet may have a magnetic field and the other of the faucet head and the faucet body may include an electromagnet. The electromagnet is switchable between an energized state and a de-energized state, wherein in the energized state the electromagnet exhibits an electromagnetic field oriented in a direction opposite the magnetic field of the magnet and thereby repels the faucet body from the faucet head.

In an alternative aspect of this embodiment, the magnetic coupling includes a head connector disposed on the faucet head and a body connector disposed on the faucet body. Each of the head connector and body connector includes a magnet. The magnet of each of the head connector and the body connector may include a single magnetic field oriented in the same direction such that the magnetic coupling exhibits a single mode attracting the head connector to the body connector. Alternatively, the magnet of each of the head connector and the body connector may include multiple magnetic fields. In this case, a number of the multiple magnetic fields are oriented in a first direction and the remaining of the multiple magnetic fields are arranged in a second direction. The second direction is substantially opposite the first direction such that, when the multiple magnetic fields of the head connector magnet are oriented in the same direction as the multiple magnetic fields of the body connector magnet, the magnetic coupling exhibits a first attracting mode and, when the multiple magnetic fields of the head connector magnet are oriented in a direction opposite the multiple magnetic fields of the body connector magnet, the magnetic coupling exhibits a second repelling mode.

In another illustrative embodiment, the faucet includes a faucet head, a faucet body and a magnetic coupling releasably coupling the faucet head to the faucet body. The magnetic coupling includes a head connector disposed on the faucet head and a body connector disposed on the faucet body. At least one of the head connector and the body connector has a first magnet and the other of the head connector and the body connector has a magnetically attractive member. The magnetically attractive member may be formed of steel, iron or a mixture thereof. The magnetically attractive member may include a second magnet having a second magnetic field oriented in the same direction as the magnetic field of the first magnet.

According to a further illustrative embodiment, a method of coupling and uncoupling a faucet head from a faucet body is provided. The method includes the steps of providing a head connector on the faucet head, providing a body connector on the faucet body, and generating a magnetic field attracting the head connector and the body connector, thereby coupling the faucet head to the faucet body.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

Figure 1:
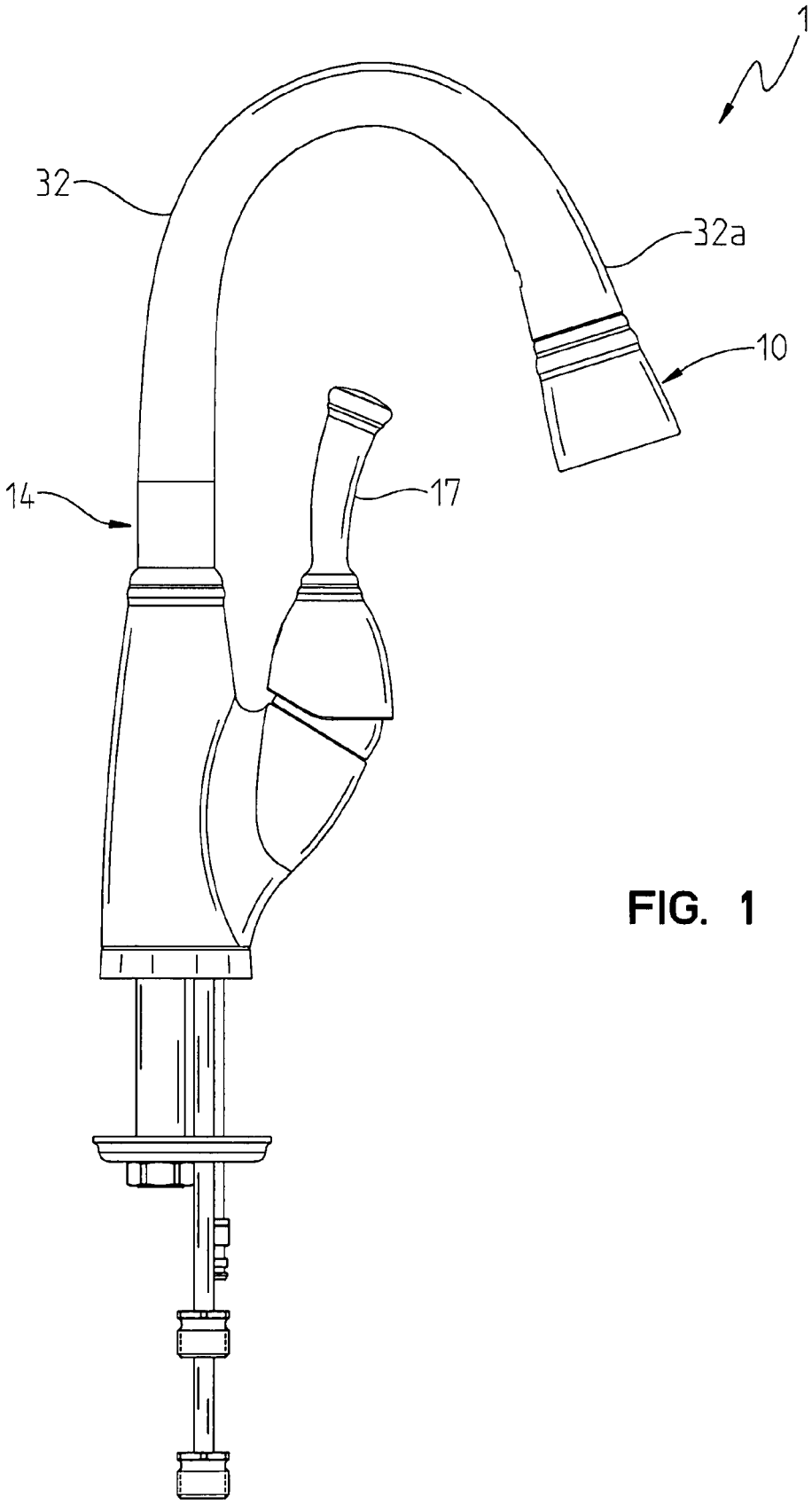
FIG. 1 is a side view of a faucet in accordance with one embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE DRAWINGS

The embodiments hereinafter disclosed are not intended to be exhaustive or limit the invention to the precise forms disclosed in the following description. Rather the embodiments are chosen and described so that others skilled in the art may utilize its teachings.

Figure 2:
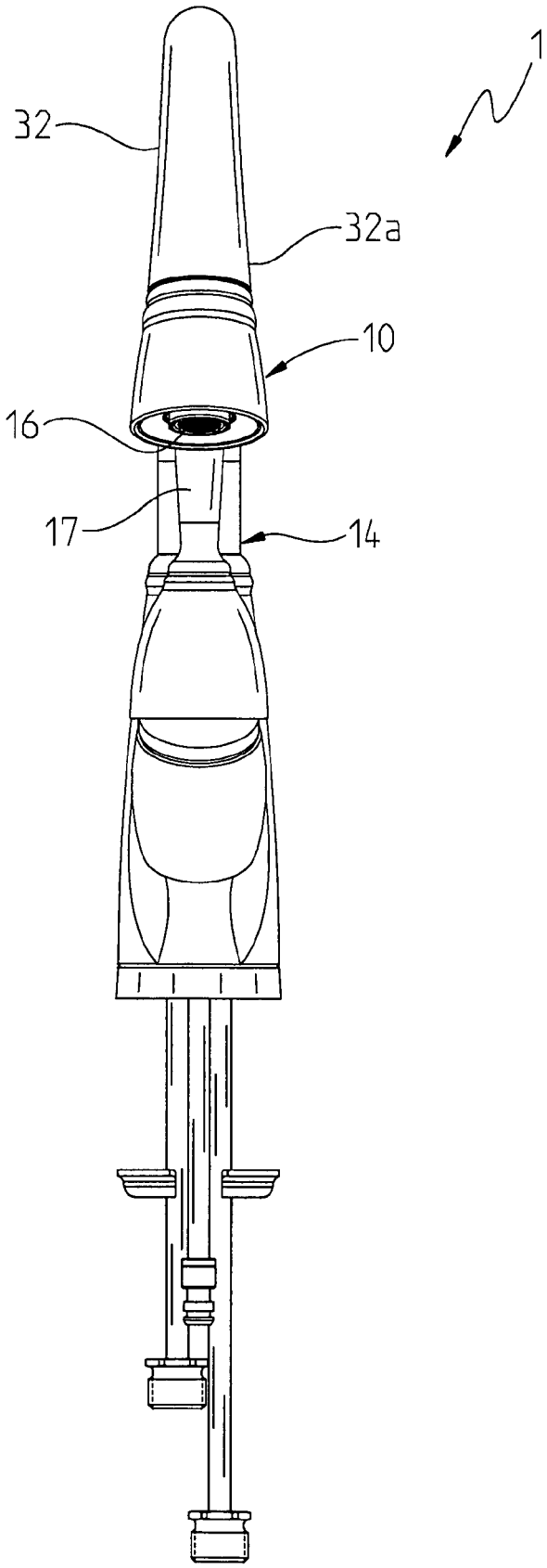
FIG. 2 is front view of the faucet of FIG. 1.

Referring first to FIGS. 1 and 2, faucet 1 according to one embodiment of the present invention is illustrated. Faucet 1 generally includes sprayhead 10 and faucet body 14. Faucet 1 is of the type wherein sprayhead 10 may be pulled out and manipulated independent of body 14. More particularly, faucet body 14 includes neck or delivery spout 32 having dispensing end 32*a* to which sprayhead 10 is releasably coupled, as is described in further detail below.

Figure 3:
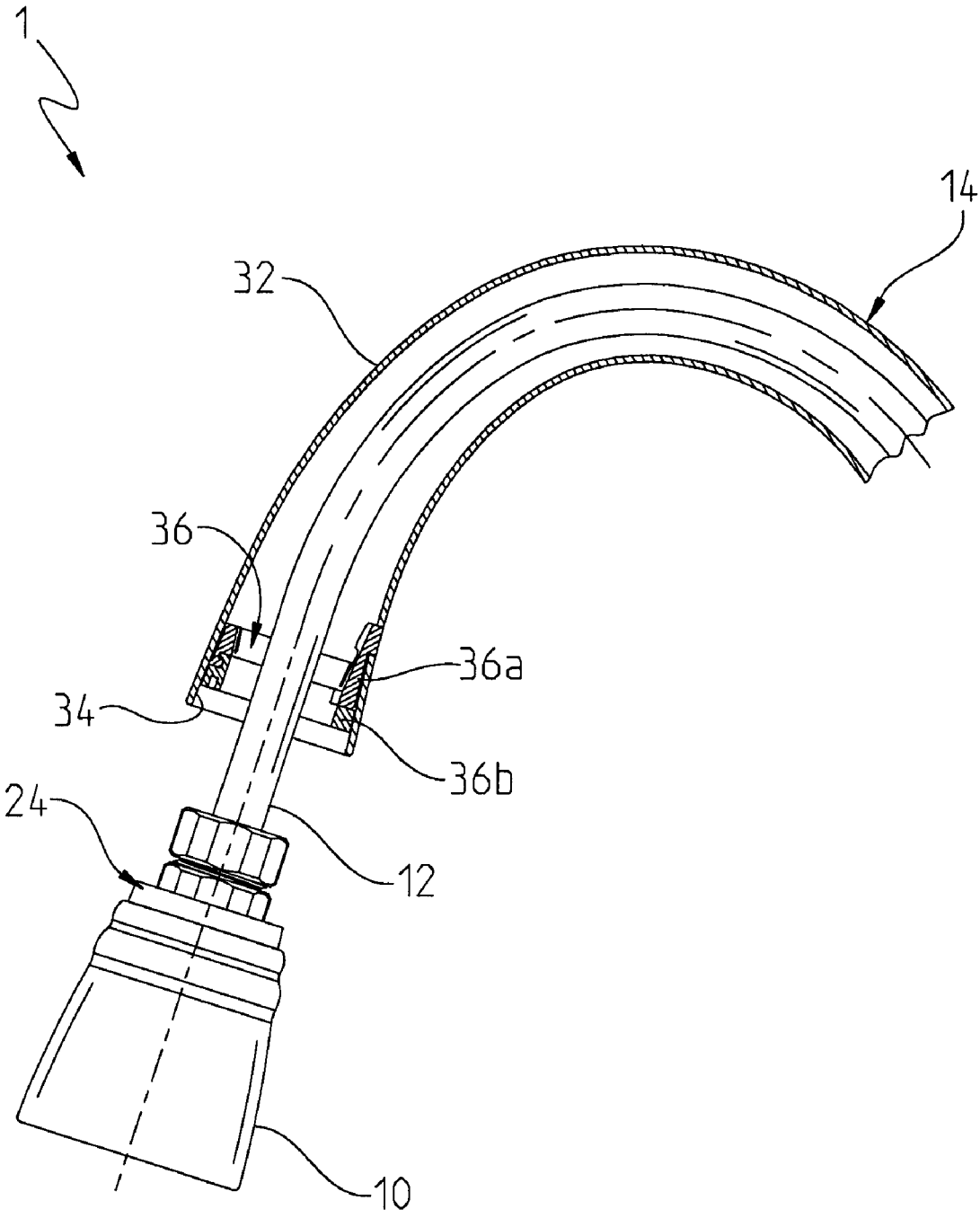
FIG. 3 is a partial cross-sectional view of a portion of the faucet of FIG. 1.
Figure 4:
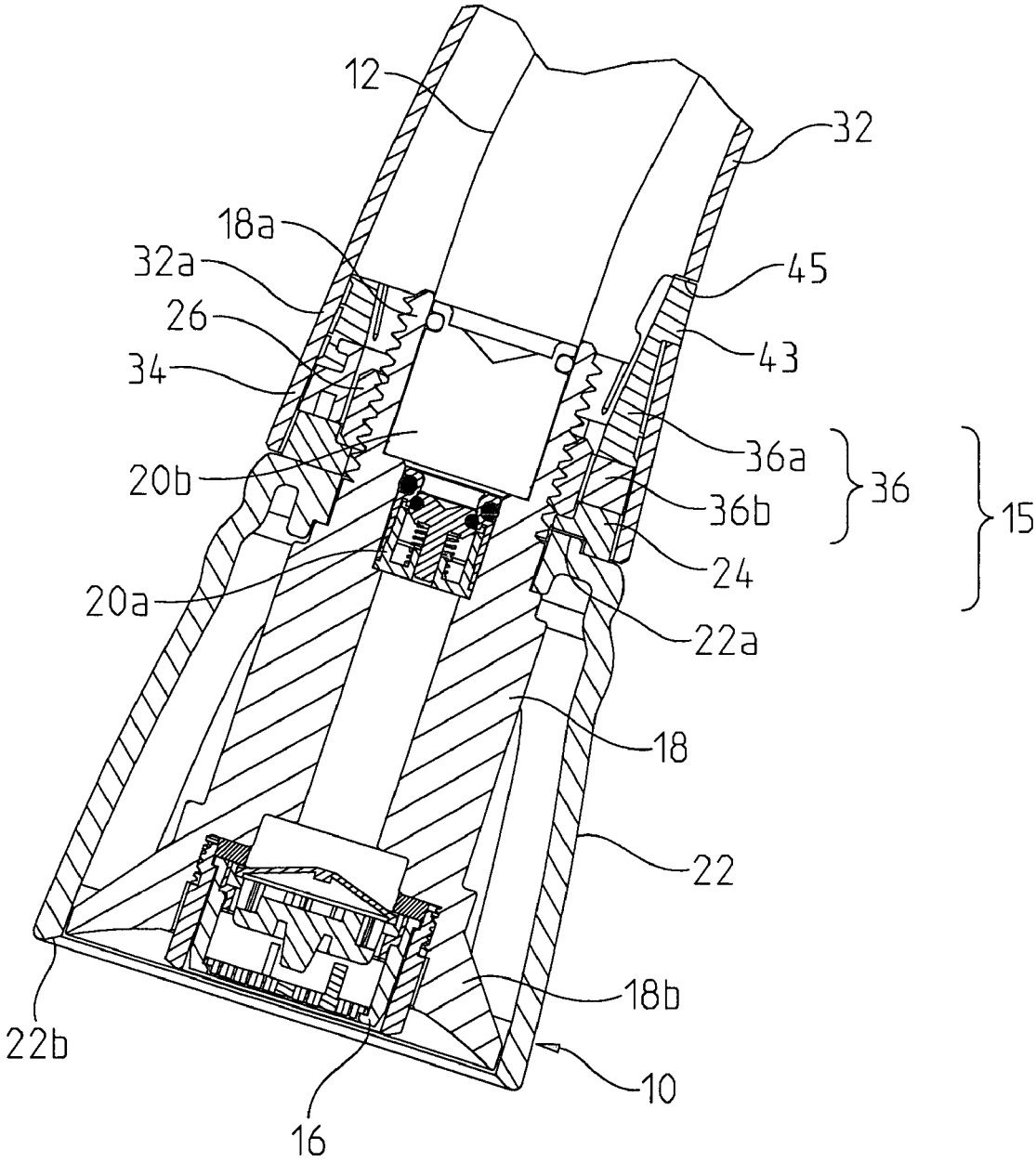
FIG. 4 is a detailed cross-sectional view of a portion of the faucet of FIG. 1.
Figure 5:
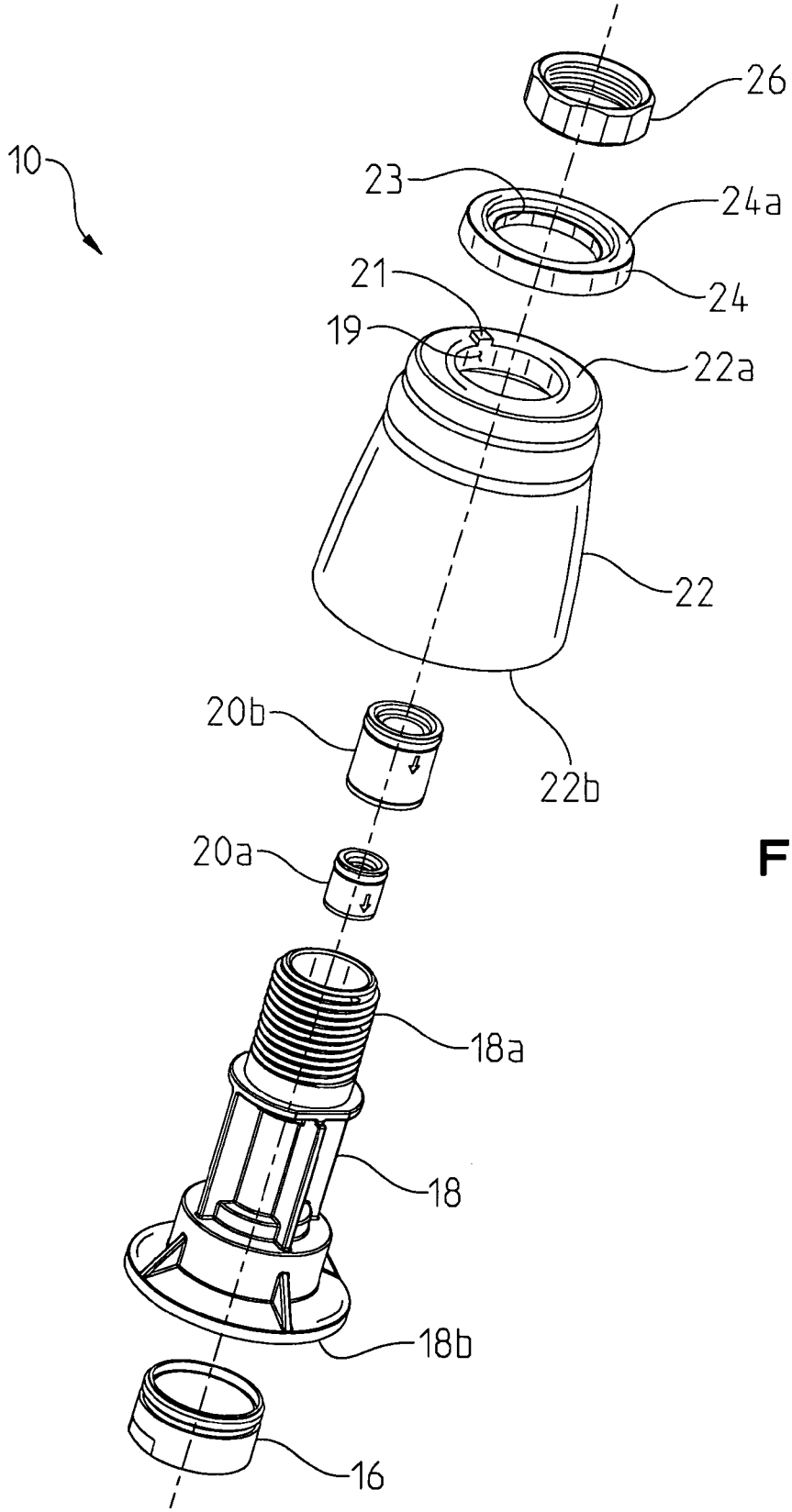
FIG. 5 is an exploded perspective view of the faucet of FIG. 4.

Referring now to FIGS. 3-5, faucet 1 also includes flexible water supply line or spout tube 12, which extends through neck 32 and is fluidly coupled at a first end to a water supply source, illustratively through a valve (not shown) operably coupled to a handle 17 (FIG. 1). A second end of the water supply line 12 is fluidly coupled to sprayhead 10. The faucet 1 may include additional features detailed in U.S. patent application Ser. No. 11/325,128, filed Jan. 4, 2006, the disclosure of which is expressly incorporated by reference herein.

Sprayhead 10 is coupled to neck 32 of faucet body 14 by magnetic coupling 15. Magnetic coupling 15 generally includes head connector member 24 coupled to sprayhead 10 and body connector member 36 coupled to neck 32 of faucet body 14. As described in further detail below, head connector member 24 and body connector member 36 are adapted to releasably engage with one another to thereby releasably couple sprayhead 10 to neck 32 of faucet body 14.

Turning now to FIGS. 4 and 5, sprayhead 10 includes aerator 16, waterway member 18, check valves 20*a* and 20*b*, shell 22, head connector member 24 and retaining nut 26. Aerator 16 is received in and coupled to dispensing end 18*b* of waterway member 18. Check valves 20*a*, 20*b* are received in and coupled to threaded receiving end 18*a* of waterway member 18. The assembly of aerator 16, waterway member 18 and check valves 20*a*, 20*b* are disposed within shell 22. Shell 22 includes receiving end 22*a* and opposing dispensing end 22*b*. Tab 21 protrudes from receiving end 22*a* and, as discussed in further detail below, serves to align head connector member 24 on receiving end 22*a* of shell 22. When the assembly of aerator 16, waterway member 18 and check valves 20*a*, 20*b* is disposed in shell 22, threaded receiving end 18*a* extends through opening 19 in receiving end 22*a* of shell 22. Threaded receiving end 18*a* of waterway member 18 also extends through opening 23 of head connector member 24 and receives retaining nut 26, which secures head connector member 24 to shell 22. Threaded receiving end 18*a* of waterway member 18 then extends from nut 26 and is fluidly coupled with water supply line 12.

Turning to FIGS. 5 and 7A-7E, head connector member 24 is substantially ring-shaped and includes top surface 24*a*, opposing bottom surface 24*b* and opening 23 extending therethrough from top surface 24*a* to bottom surface 24*b*. Opening 23 is sized to receive threaded receiving end 18*a* of waterway member 18 therethrough. Notch 25 is cut into bottom surface 24*b* and is configured to receive tab 21 of shell 22 to facilitate proper angular orientation therebetween.

Referring now to FIGS. 4 and 6A-6E, body connector member 36 is disposed within dispensing end 32*a* of neck 32. A portion of neck 32 extends past body connector member 36 to form collar 34, which is configured to removably and concentrically receive therein head connector member 24 and receiving end 18*a* of waterway 18. Body connector member 36 includes opening 38, which extends through body connector member 36 and is configured to receive receiving end 18*a* of waterway member 18 therethrough. Body connector member 36 includes base 36*a* and connecting portion 36*b*. Base 36*a* illustratively serves to couple body connector member 36 to faucet body 14, while connecting portion 36*b* interacts with head connector member 24 to releasably couple sprayhead 10 to faucet body 14, as is described in further detail below.

Base 36*a* includes resilient clip or snap finger 43 extending upwardly and outwardly therefrom. Slot 45 extends through neck 32 of faucet body 14 and is configured to receive clip 43. Clip 43 is snap-received within slot 45 to secure body connector member 36 in neck 32 of faucet body 14. Recess 39 extends into and about a portion of the inner periphery of base 36*a*. Lip 41 extends from and about a portion of the outer periphery of connecting portion 36*b*. Lip 41 is configured to engage with recess 39 to thereby couple connecting portion 36*b* to base 36*a*. Base 36*a* may be formed of any suitable material. In one embodiment, base 36*a* is formed of plastic and is overmolded to connecting portion 36*b*. It should be understood that body connector member 36 need not include two separate components. Rather base 36*a* and connecting portion 36*b* may be integrally formed as a single unit, such that body connector member 36 is one piece.

Figure 6A:
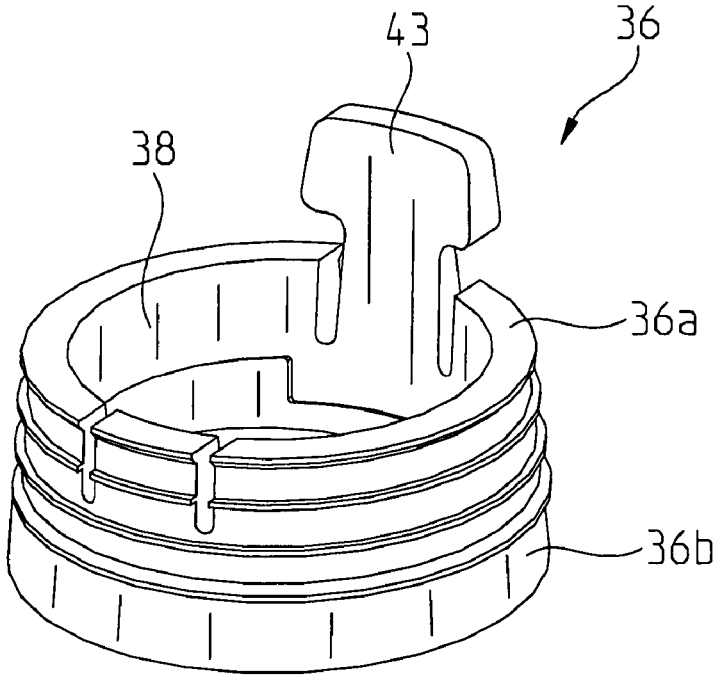
FIG. 6A is a perspective view of the body connector member of the faucet of FIG. 4.
Figure 6E:
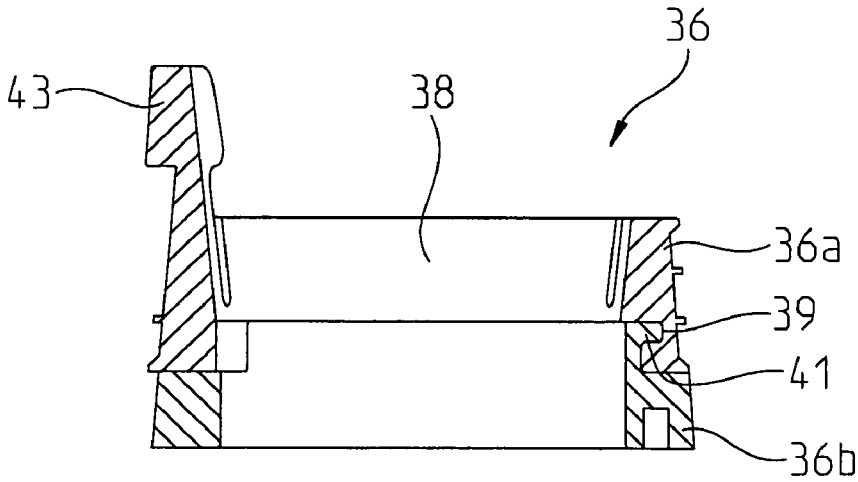
FIG. 6E is a cross-sectional view of the body connector member of FIG. 6C taken along line 6E-6E.
Figure 6C:
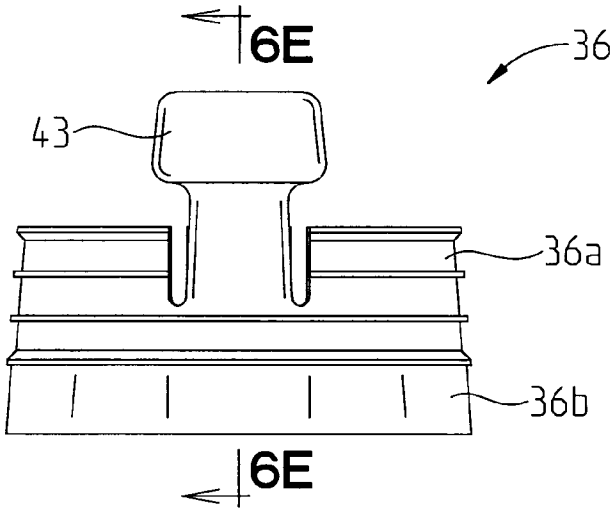
FIG. 6C is another side view of the body connector member of FIG. 6A.
Figure 6B:
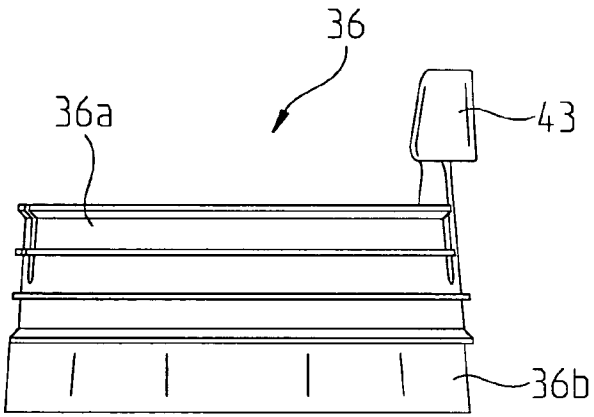
FIG. 6B is a side view of the body connector member of FIG. 6A.
Figure 6D:
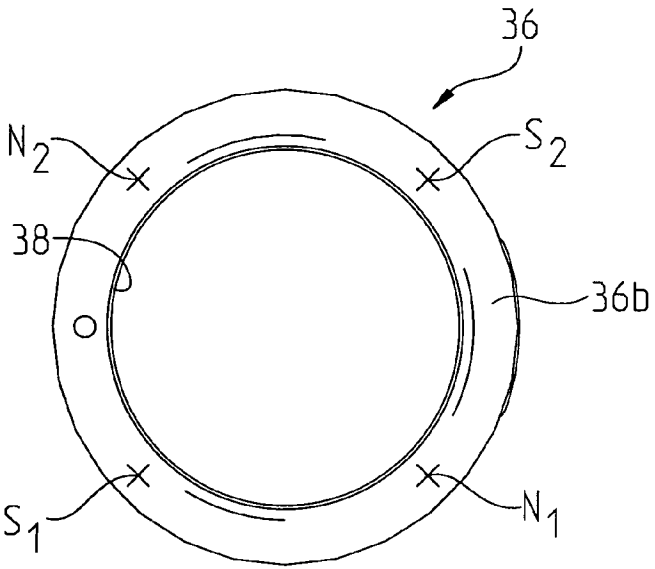
FIG. 6D is a bottom view of the body connector member of FIG. 6A.
Figure 7A:
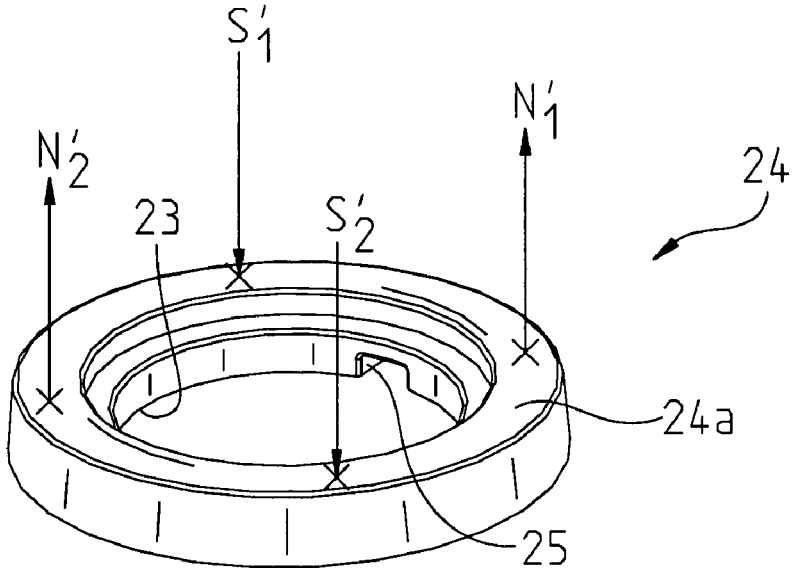
FIG. 7A is a perspective view of the head connector member of the faucet of FIG. 4.
Figure 7E:
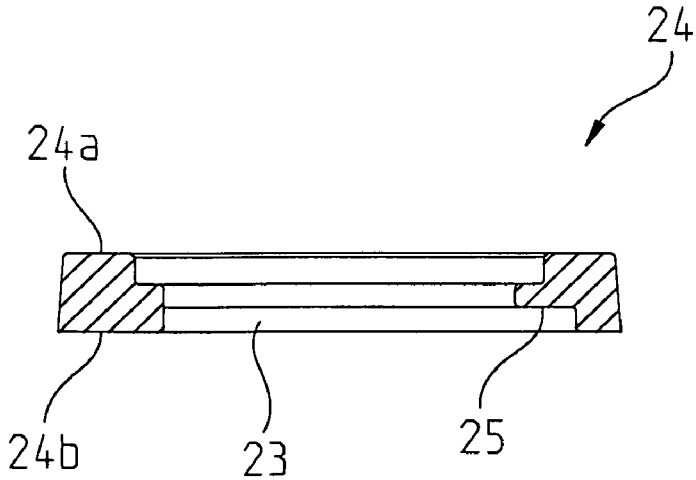
FIG. 7E is a cross-sectional view of the head connector member of FIG. 7C taken along line 7E-7E.
Figure 7B:
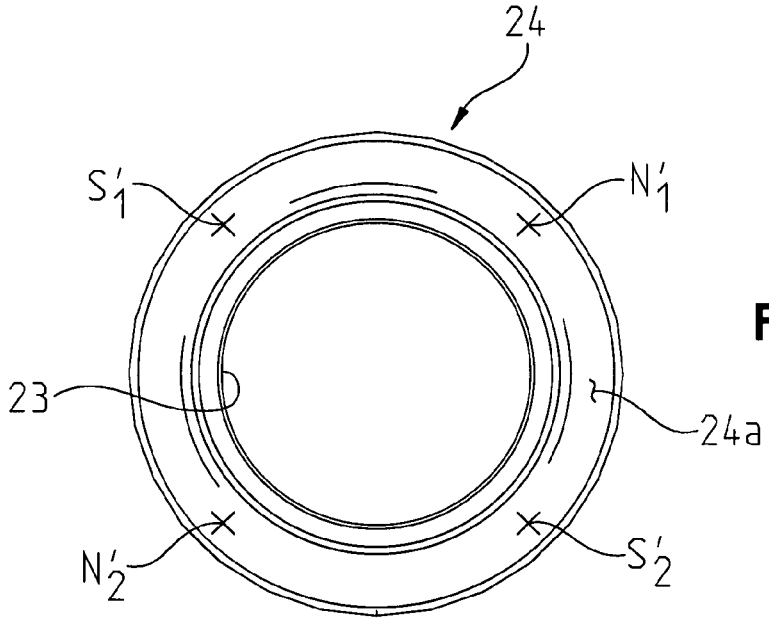
FIG. 7B is a top view of the head connector member of FIG. 7A.
Figure 7C:
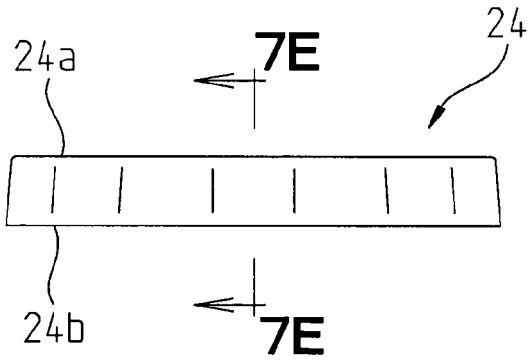
FIG. 7C is a side view of the head connector member of FIG. 7A.
Figure 7D:
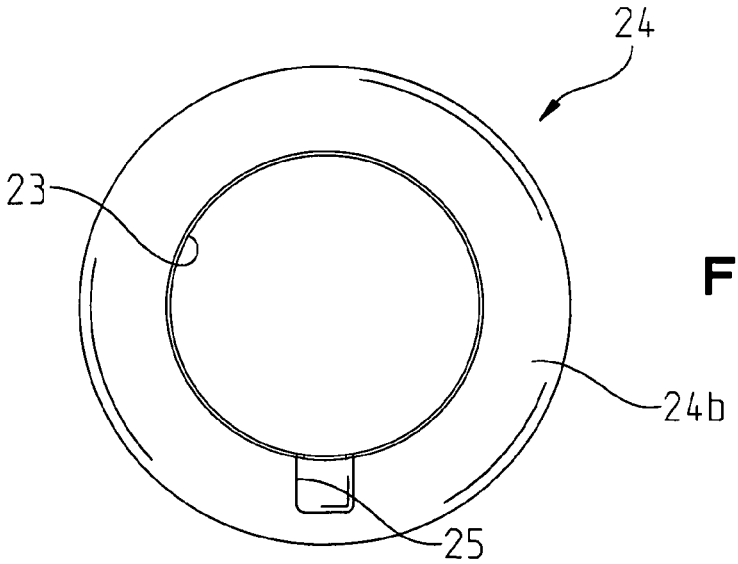
FIG. 7D is a bottom view of the head connector member of FIG. 7A.

Referring now to FIGS. 3, 4, 6D, 7A, 7B, 8A, and 8B, the interaction between connecting portion 36*b* of body connector member 36 with head connector member 24 to releasably couple sprayhead 10 to faucet body 14 will now be described. As shown in FIGS. 6D, 7A, and 7B and diagrammatically in FIGS. 8A and 8B, head connector member 24 and connecting portion 36*b* of body connector member 36 may be in the form of magnets adapted to attract one another.

As known in the art, magnets have magnetic fields characterized by their strength and orientation. Magnetic poles are limited regions in the magnet at which the field of the magnet is most intense, each of which is designated by the approximate geographic direction to which it is attracted, north (N) or south (S). The direction of the magnetic field is the direction of a line that passes through the north and south poles of the magnet. Generally, the direction is perpendicular to the magnetic surface of the magnet. The orientation of the field may be characterized as the direction pointed to by the north pole of the magnet.

Magnets may be characterized in several different ways. For instance, the magnet type may be a permanent magnet or an electromagnet. A permanent magnet exhibits a permanent (i.e. constant) magnetic field. An electromagnet generates a magnetic field only when a flow of electric current is passed through it. The magnetic field generated by the electromagnet disappears when the current ceases.

Magnets with a single magnetic field are considered dipolar because they have two poles, a north and a south pole. The magnetic field of a dipolar magnet may interact with the magnetic field of other magnets to produce a repelling or an attracting force. The magnetic field may also interact with certain attractable materials, such as iron or steel, that are naturally attracted to magnets.

The strength of the attracting or repelling magnetic force is determined by the strength of the magnetic field of the magnet and by the degree of interaction between the magnetic field and a component that enters the field. The strength of a magnetic field is determined by the construction of the magnet. The strength of an electromagnetic field can be changed by changing the current that flows through the electromagnet. The degree of interaction is determined by the size of the magnetic surface that interacts with the component entering the field and by the distance between the magnet and the component entering the field. The magnetic force of a magnet, therefore, may be changed by changing the position of the magnet relative to another magnet or to the attractable material.

As is also well-known in the art of magnets, unlike-poles attract and like-poles repel. Accordingly, when two dipolar magnets come into close proximity and their magnetic fields are oriented in the same direction, they attract one another. The north pole on the proximal surface of one magnet attracts the south pole on the proximal surface of the other magnet. On the other hand, when two dipolar magnets come into close proximity and their magnetic fields are oriented in opposite directions, they repel one another. For example, the north pole on the proximal surface of one magnet repels the north pole on the proximal surface of the other magnet.

Magnets may also include multiple magnetic fields oriented in opposite directions. In this case, when two multi-field magnets come in close proximity to one another, they will repel one another if the multiple fields are not oriented in the same direction, and will attract one another if oriented in the same direction. As such, these multi-fold magnets provide two modes: an attracting mode and a repelling mode. Such magnets may be referred to as bi-modal.

Figure 8A:
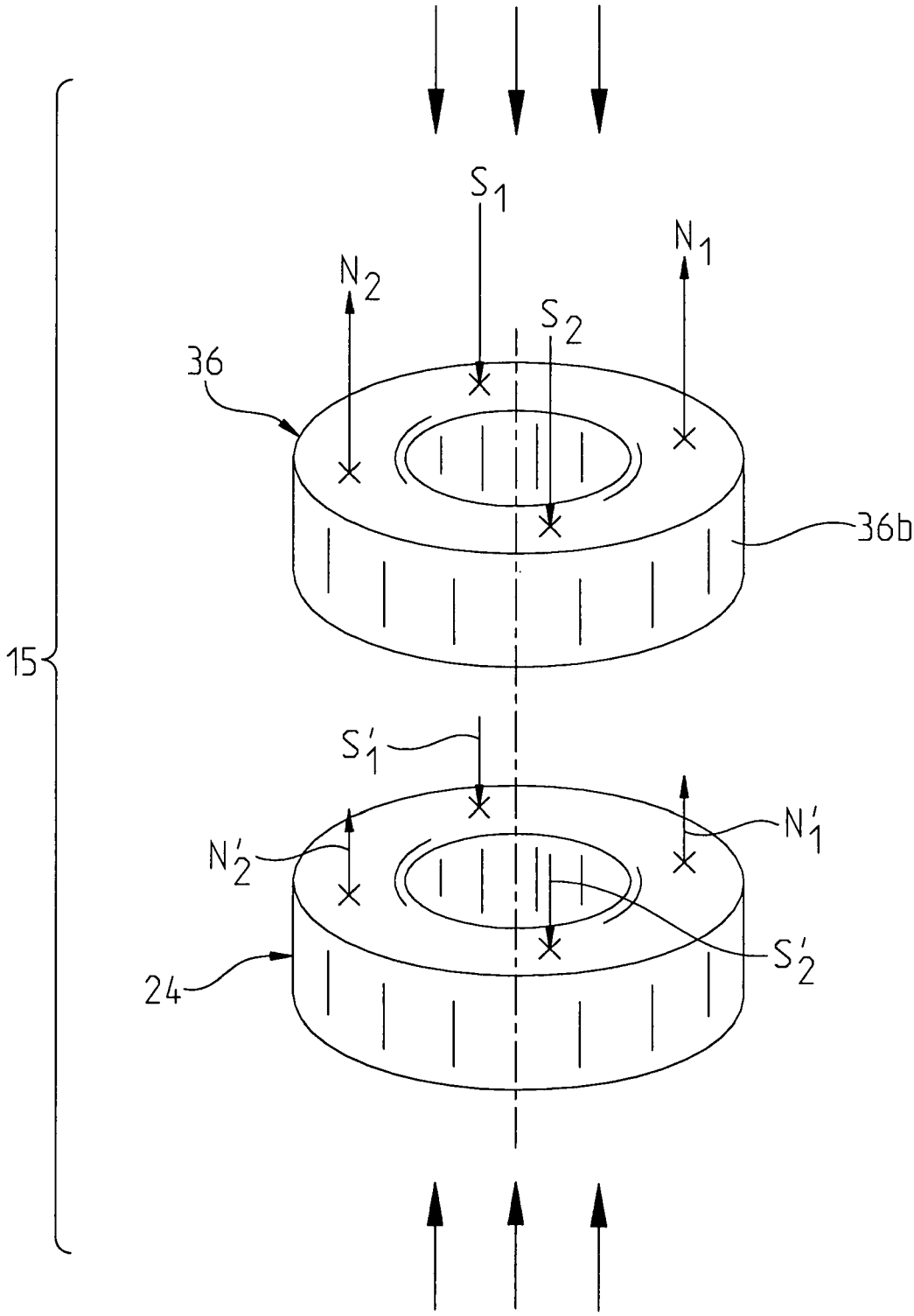
FIG. 8A is diagrammatic view of the magnetic coupling of the faucet of FIG. 4 in the attracting mode.
Figure 8B:
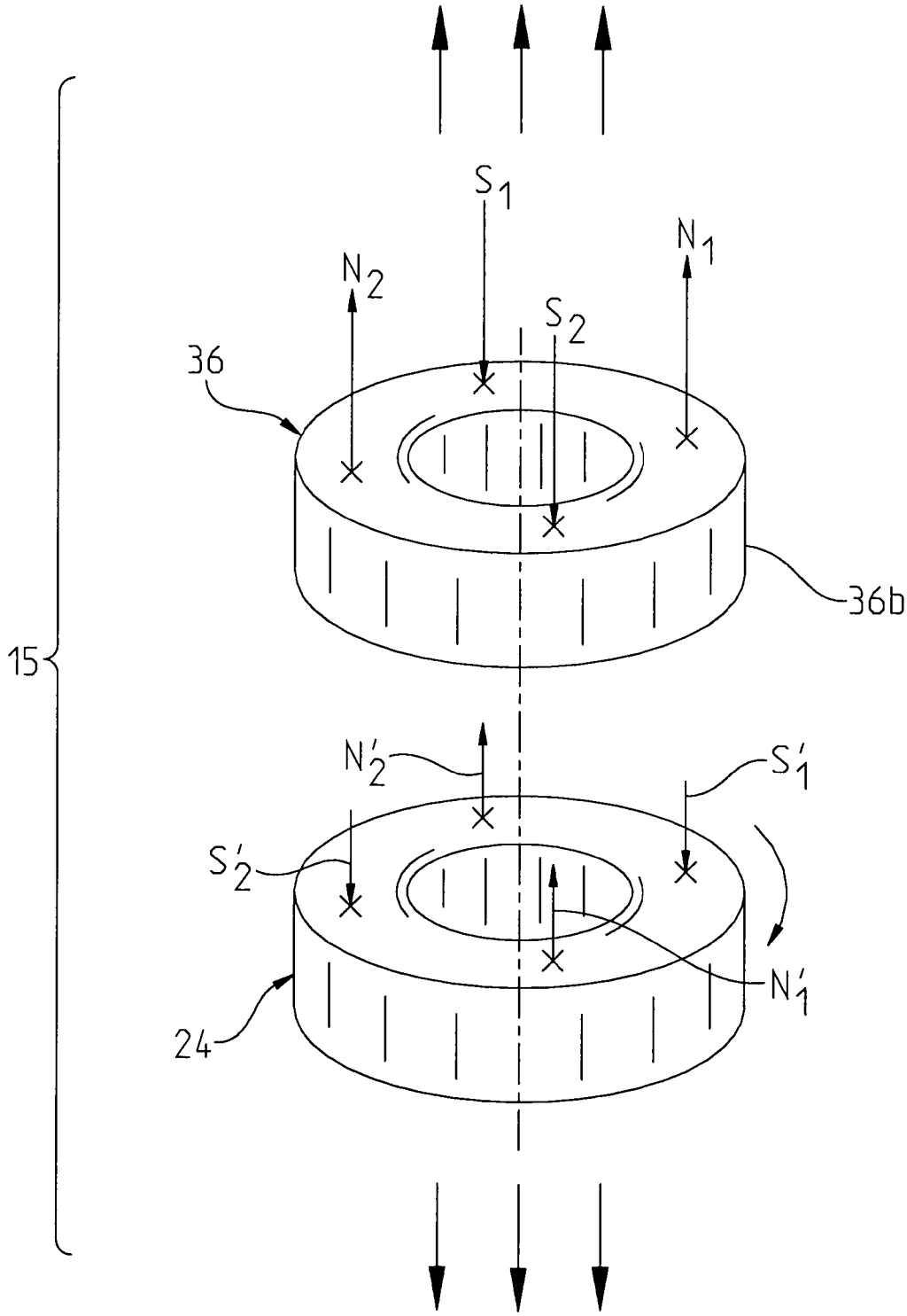
FIG. 8B is a diagrammatic view of the magnetic coupling of the faucet of FIG. 4 in the repelling mode.

As shown in FIGS. 8A and 8B, magnetic coupling 15 may be bi-modal in that it includes an attracting mode (FIG. 8A) and a repelling mode (FIG. 8B), and may be adjusted between the two modes. In this case, as further shown in FIGS. 6D, 8A, and 8B, connecting portion 36*b* of body connector member 36 includes multiple magnetic fields $S_1$, $N_1$, $S_2$, $N_2$ arranged alternately in opposing directions. Similarly, as shown in FIGS. 7A, 7B, 8A, and 8B, head connector member 24 includes multiple magnetic fields $S_1'$, $N_1'$, $S_2'$, $N_2'$ arranged alternately in opposing directions. With reference to FIG. 8A, in the attracting mode, head connector member 24 is arranged relative to body connector member 36 such that magnetic fields $S_1'$, $N_1'$, $S_2'$, and $N_2'$ of head connector member 24 are aligned with and oriented in the same direction as magnetic fields $S_1$, $N_1$, $S_2$, and $N_2$ of body connector member 36, respectively. In this orientation, when head connector member 24 is brought in close proximity to body connector member 36, the two are attracted to one another, as indicated by the solid-headed arrows. Turning to FIG. 8B, head connector member 24 has been rotated clockwise by approximately 90 degrees, such that magnetic fields $S_1'$, $N_1'$, $S_2'$, and $N_2'$ of head connector member 24 are now aligned with and oriented in directions opposite to magnetic fields $N_1$, $S_2$, $N_2$ and $S_1$, respectively, of body connector member 36. In this orientation, when head connector member 24 is brought in close proximity to body connector member 36, the two are repelled from one another as indicated by the solid-headed arrows.

Referring to FIGS. 3, 4, 8A, and 8B, in practical operation of faucet 1, magnetic coupling 15 releasably couples sprayhead 10 to neck 32 of faucet body 14 using the attracting mode shown in FIG. 8A. In other words, magnetic fields $S_1$, $N_1$, $S_2$, and $N_2$ of body connector member 36 are respectively aligned with and oriented in the same direction as magnetic fields $S_1'$, $N_1'$, $S_2'$, and $N_2'$ of head connector member 24, such that head connector member 24 and the remaining components of sprayhead 10 are attracted and held to body connector member 36, as shown in FIG. 4. When the user desires to pull sprayhead 10 out from neck 32, the user may simply pull sprayhead 10 away from neck 32 with enough force to overcome the attracting magnetic forces between head connector member 24 and body connector member 36. To ease the release of sprayhead 10 from neck 32, the user may also rotate sprayhead 10 by approximately 90 degrees and, thus, head connector member 24, until magnetic coupling 15 exhibits its repelling mode, shown in FIG. 8B. In other words, sprayhead 10 may be rotated until magnetic fields $S_1'$, $N_1'$, $S_2'$, and $N_2'$ of head connector member 24 are oriented in opposing directions relative to magnetic fields $N_1$, $S_2$, $N_2$ and $S_1$ of body connector member 36. In this orientation, coupling 15 assists the user in pulling sprayhead 10 from neck 32 by providing a repelling force that repels head connector member 24 from body connector member 36.

Figure 9:
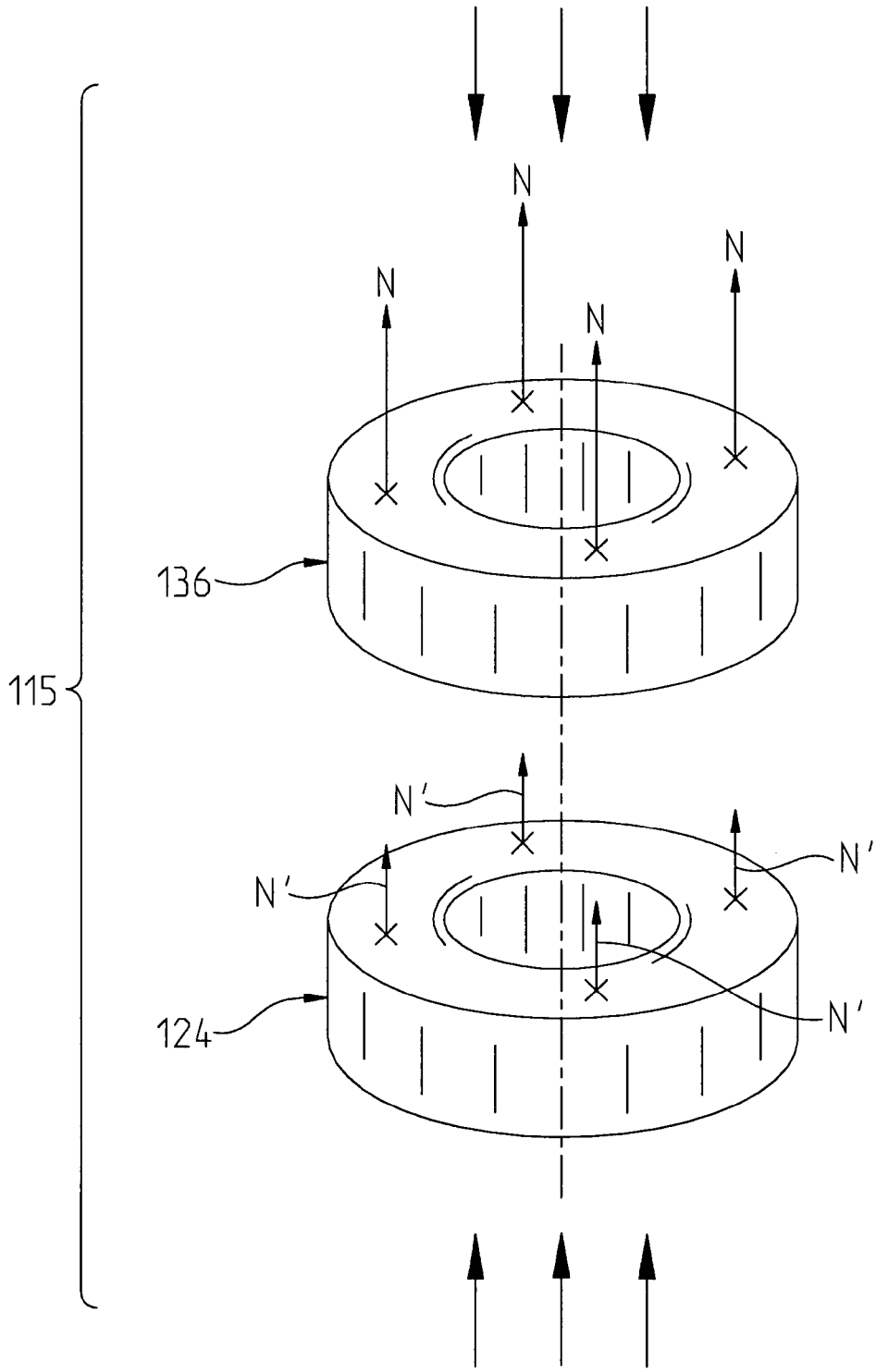
FIG. 9 is a diagrammatic view of an alternative magnetic coupling for use in the faucet of FIG. 4.

It should be understood that the magnetic coupling of sprayhead 10 to body 14 may be achieved without the use of multi-field magnets. Alternatively, faucet 1 may be equipped with uni-modal magnetic coupling 115 through the use of dipolar magnets, as schematically illustrated in FIG. 9. Magnetic coupling 115 includes head connector member 124 and body connector member 136, which may be respectively coupled to sprayhead 10 and body 14 in a manner similar to that of magnetic coupling 15 described above. Head connector member 124 includes only one magnetic field N, while body connector member 136 includes only one magnetic field N', which is oriented in the same direction as magnetic field N. Accordingly, when the sprayhead 10 is brought in close proximity to neck 32 of faucet body 14, body connector member 136 attracts and holds head connector member 124 thereto. To release sprayhead 10 from neck 32, the user pulls sprayhead 10 away from neck 32 with enough force to overcome the attractive force between body connector and head connector members 136 and 124.

Figure 10:
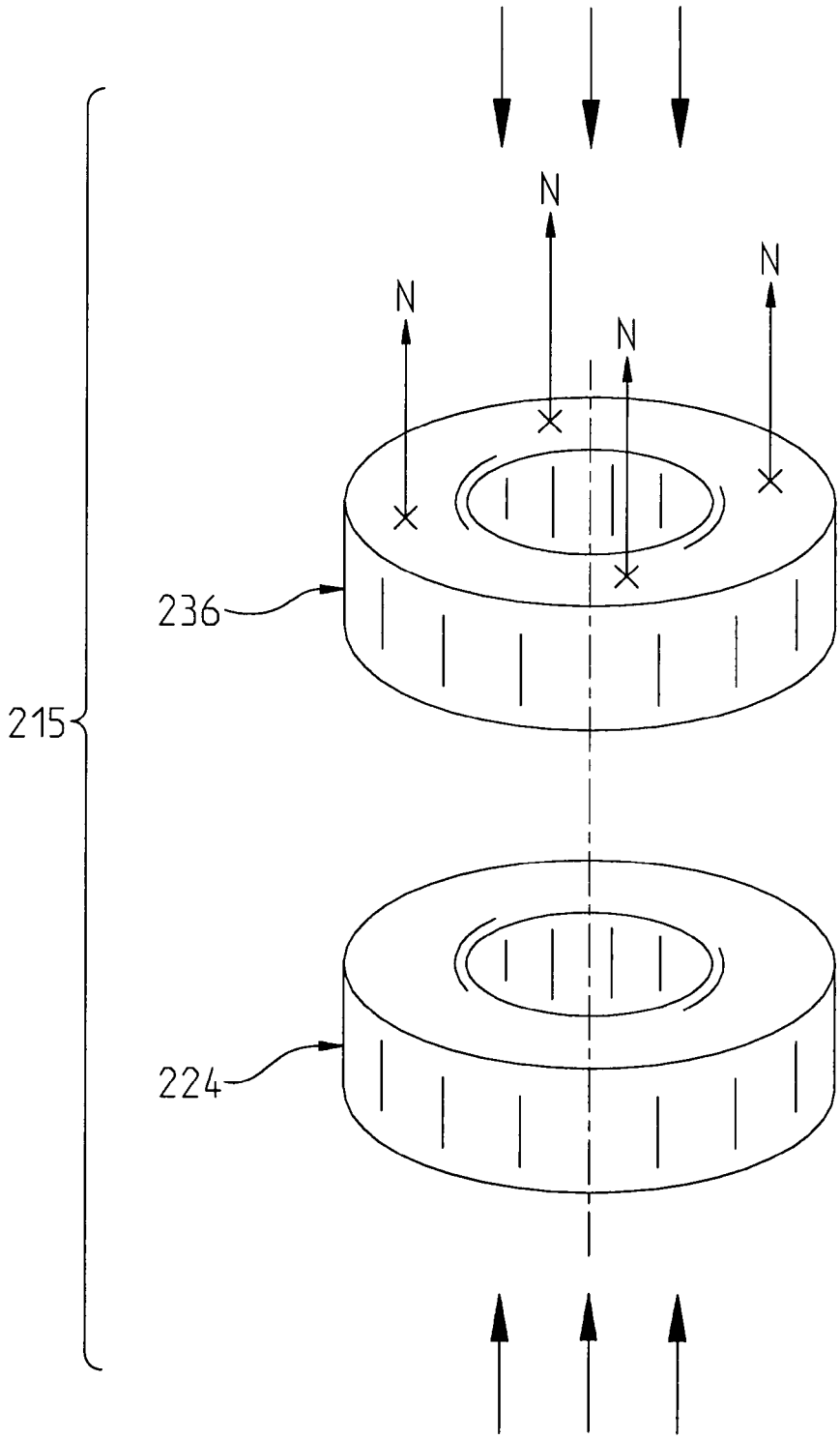
FIG. 10 is a diagrammatic view of another alternative magnetic coupling for use in the faucet of FIG. 4.

It should be noted that the magnetic coupling need not employ two magnets. For instance, as schematically illustrated in FIG. 10, magnetic coupling 215 includes body connector member 236, which is a dipolar magnet having single magnetic field N, and head connector member 224, which is formed of a magnetically attractable material, such as iron or steel. Head connector member 224 and body connector member 236 may be coupled to sprayhead 10 and neck 32, respectively, in a manner similar to that of connector members 24, 36 described above. Sprayhead 10 is releasably held to neck 32 of faucet body 14 by the attractive force between magnetic body connector member 236 and attractable head connector member 224. It should be noted that either one of body connector member 236 or head connector member 224 may be the magnet, and the other may be formed of the magnetically attractable material.

Figure 11:
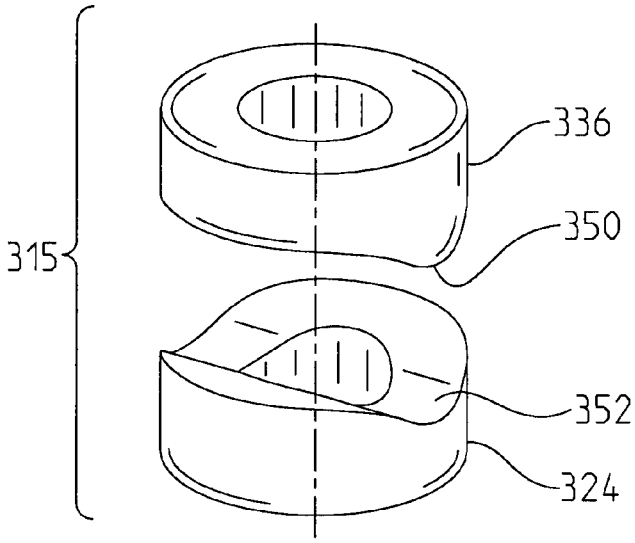
FIGS. 11, 11A and 11B are diagrammatic views of yet another alternative magnetic coupling for use in the faucet of FIG. 4 illustrating various orientations of the head connector member and body connector member.
Figure 11A:
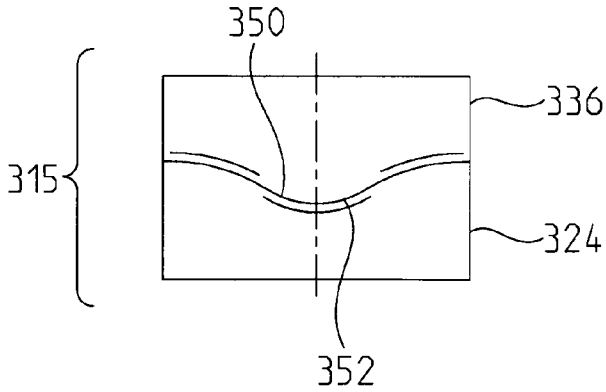
Figure 11B:
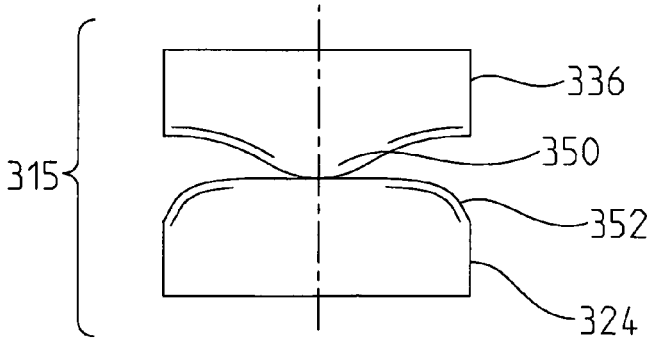

Turning now to FIGS. 11, 11A, and 11B, additional physical or structural features may be employed to guide the user in aligning and coupling the sprayhead 10 to the body 14 and releasing the sprayhead 10 from the body 14. For instance, magnetic coupling 315 includes head connector member 324 and body connector member 336, which may be respectively coupled to sprayhead 10 and body 14, as described above. Head connector member 324 and body connector member 336 may be configured like any of the embodiments described above. Body connector member 336 includes male component 350 in the form of a curved ridge or protrusion. Head connector member 324 includes female component 352 in the form of a curved recess configured to mate with and receive male component 350.

FIGS. 11 and 11A show head connector member 324 and body connector member 336 in an aligned position such that female component 352 receives male component 350. When in this position, head connector member 324 may be brought in closer proximity to body connector member 336, thereby maximizing the strength of magnetic attraction.

FIG. 11B shows head connector member 324 and body connector member 336 in a misaligned position. In this position male member 350 separates body connector member 336 from head connector member 324 to thereby reduce the magnetic force therebetween and allow the user to more easily pull the sprayhead 10 from the faucet body 14.

Male and female members 350 and 352 may have any shape such as rectangular or triangular. However, in this particular embodiment, the curved, sloping shape of female and male members 352 and 350 may also facilitate the user's rotation of head connector member 324 relative to body connector member 336 in the case where magnetic coupling 315 is a bimodal coupling, such as that in FIGS. 8A and 8B.

Figure 12A:
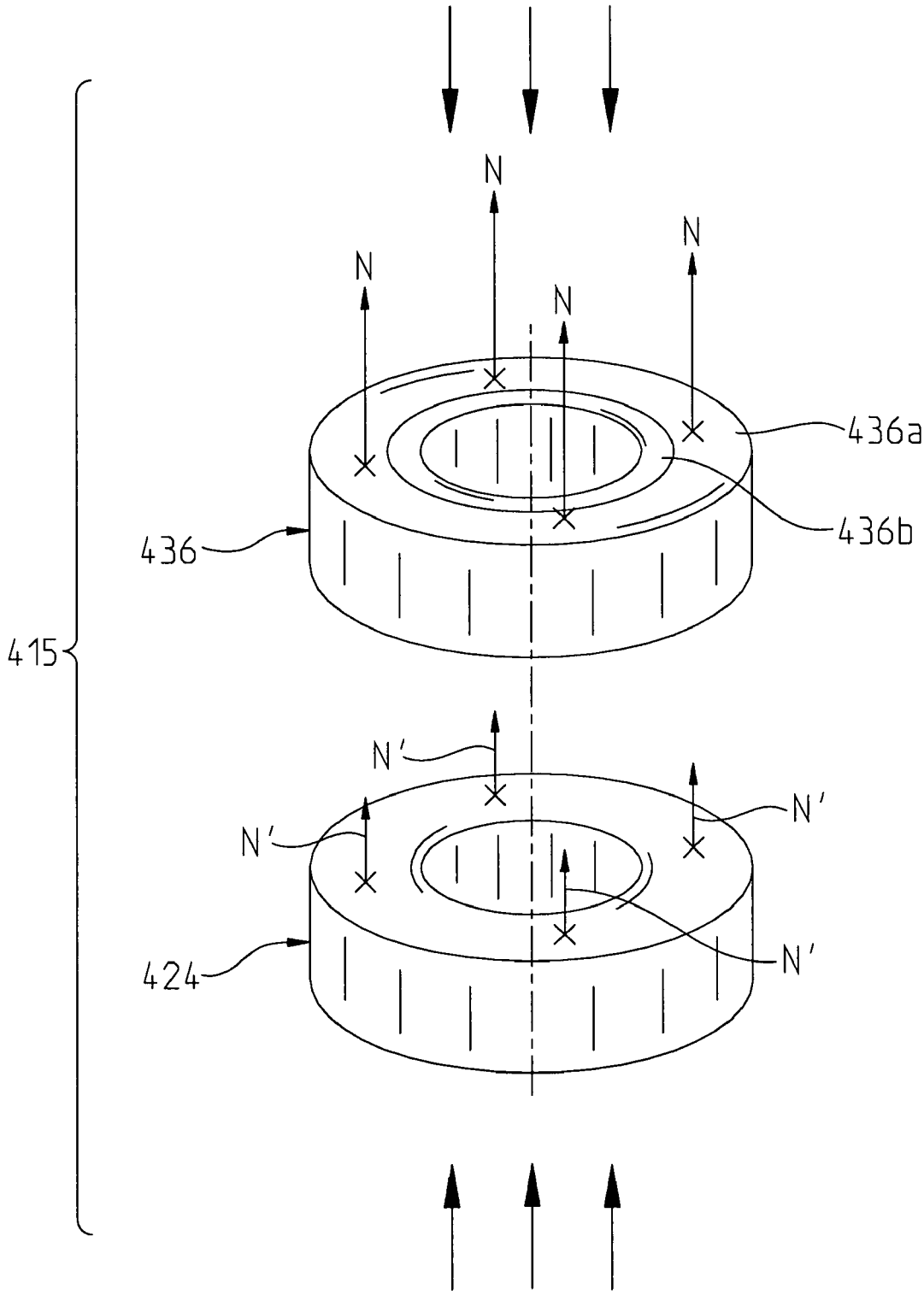
FIG. 12A is a diagrammatic view of yet another magnetic coupling for use in the faucet of FIG. 4, wherein the magnetic coupling is in the attracting mode.
Figure 12B:
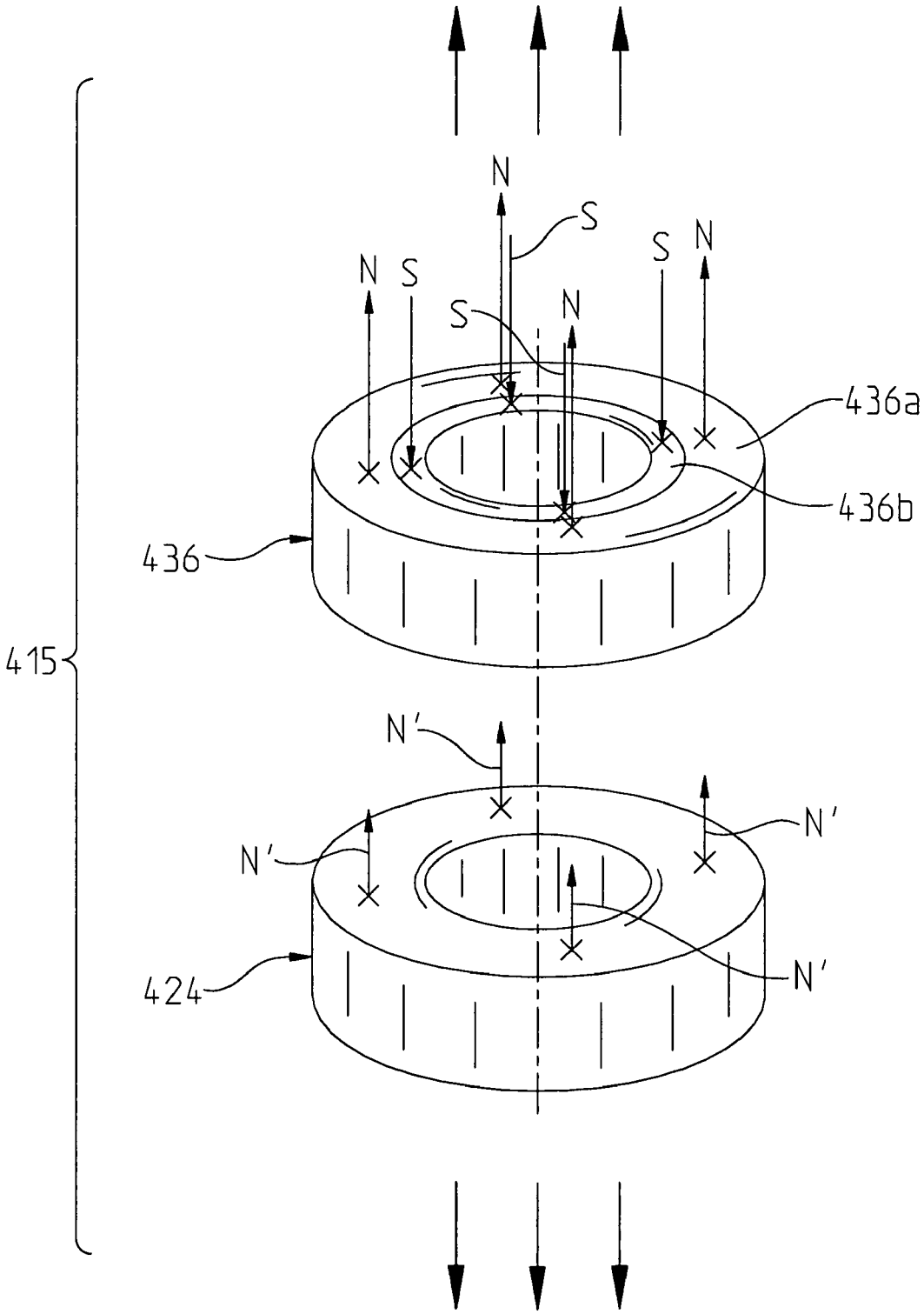
FIG. 12B is a diagrammatic view of the magnetic coupling of FIG. 12A, wherein the magnetic coupling is in the repelling mode.

It should be noted that any of the above-described embodiments may also include an electromagnet. For instance, either the head connector member or the body connector member may include an electromagnet switchable between an energized state and a de-energized state. As illustrated in FIGS. 12A and 12B, magnetic coupling 415 includes head connector member 424 and body connector member 436, which may be respectively coupled to sprayhead 10 and body 14 in the manner described above. Body connector member 436 includes a permanent magnetic portion 436*a* having magnetic field N. Head connector member 424 is a permanent magnet having magnetic field N', which is oriented in the same direction as magnetic field N. Accordingly, head connector member 424 attracts and holds body connector member 436 thereto via the attracting forces between magnetic fields N', N, as illustrated by the solid headed arrows in FIG. 12A. Body connector member 436 also includes electromagnet portion 436*b*, which is coupled to an energy source, such as a battery, by any known means and is capable of being energized and de-energized by any known means, such as by employing an on/off power switch. Electromagnet portion 436*b*, when energized, is configured to generate magnetic field S, which is oriented in the opposite direction to magnetic field N of permanent magnet portion 436*a* of body connector member 436. Therefore, when energized, electromagnet portion 436*b* cancels out the attractive force between magnetic fields N, N' and illustratively repels head connector member 424 from body connector member 436 to, thereby, ease the release of sprayhead 10 from body 14. When not energized, electromagnet portion 436*b* generates no magnetic field, thereby allowing head connector member 424 to be attracted and held to body connector member 436. It should be noted that the electromagnet may be disposed on either of body connector member 436 or head connector member 424, and may be employed in any of the magnetic coupling embodiments described above.

Figure 13:
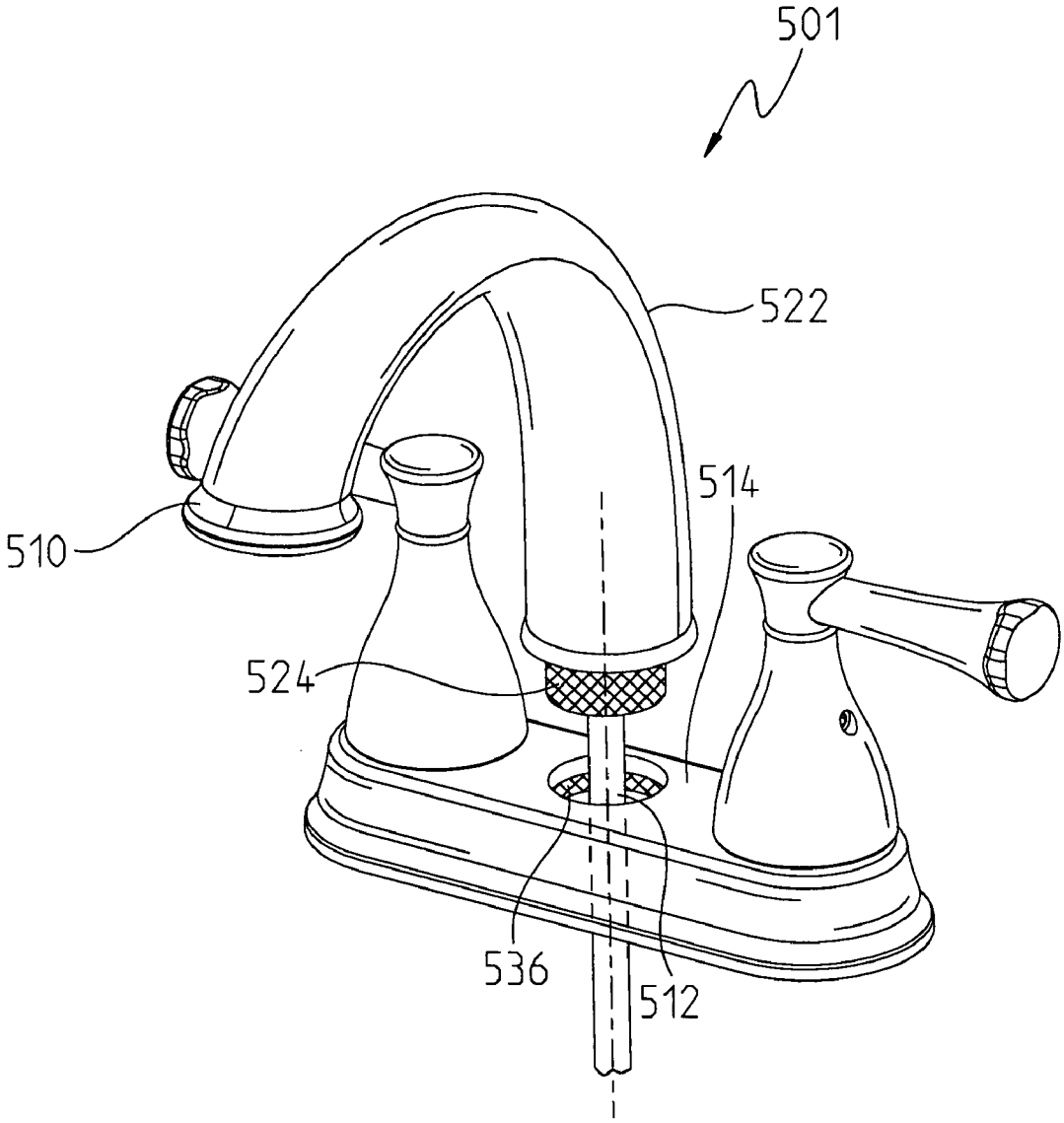
FIG. 13 is a perspective view of a faucet in accordance with another illustrative embodiment of the present invention.

Turning to FIG. 13, faucet 501 is illustrated. Faucet 501 is of a different design than faucet 1 of FIGS. 1-2, but may still employ any of the magnetic coupling embodiments described above. Faucet 501 includes body 514 and sprayhead 510, which is releasably coupled to body 514. Neck or delivery spout 522 is part of sprayhead 510 and, thus, is removable from body 514 along with sprayhead 510. Sprayhead 510 includes head connector member 524 and is coupled to water line 512. Body 514 includes body connector member 536. Head connector member 524 and body connector member 536 cooperate with one another to form a magnetic coupling, such as those described above.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of coupling and uncoupling a faucet head from a faucet body, the faucet body including a passageway defined by an internal surface of the faucet body, and the faucet head being fluidly coupled to a supply line passing through the passageway, the method including the steps of:

providing a head connector on the faucet head;

providing an opening on the internal surface of the faucet body;

providing a body connector including an engagement surface and a protruding portion;

inserting the body connector into the passageway of the faucet body until the opening receives the protruding portion, the engagement surface and the protruding portion securing the body connector to the faucet body; and generating a magnetic field attracting the head connector and the body connector, thereby coupling the faucet head to the faucet body.

2. The method of claim 1 further comprising the steps of providing a magnet on one of the head connector and the body connector, and providing an electromagnet on the other of the head connector and the body connector, the magnet having a magnetic field oriented in a first direction, the electromagnet having an energized state generating an electromagnetic field oriented in a second direction, the second direction being substantially opposite the first direction to uncouple the head connector from the body connector.

3. The method of claim 1, wherein the engagement surface comprises a pressure ring.

4. The method of claim 1, wherein the magnetic field is generated by a first magnet supported by one of the head connector and the body connector, further comprising the step of providing a a second magnet on the other of the head connector and the body connector, each of the first magnet and the second magnet having a first magnetic field, the first magnetic field of the first magnet being oriented in the same direction as the first magnetic field of the second magnet.

5. The method of claim 4 wherein each of the first magnet and second magnet further includes a second magnetic field opposite the first magnetic field, the second magnetic field of the first magnet being oriented in the same direction as the second magnetic field of the second magnet.

6. The method of claim 1, wherein the opening comprises a through-hole.

7. The method of claim 6, wherein the opening comprises a slot.

8. The method of claim 1, wherein the opening is axially displaced from the engagement surface when the protruding portion is received by the opening.

9. The method of claim 8, wherein the body connector includes a snap-finger comprising the protruding portion.

10. A faucet for dispensing a fluid, the faucet comprising:

a fluid supply line;

a faucet head having a shell and a fluid coupling portion fluidly coupling the faucet head to the fluid supply line;

a faucet body having an elongate aperture therethrough defining an internal surface, the elongate aperture configured to slidingly receive the fluid supply line and to releasably support the faucet head, and the internal surface having an orifice; and a magnetic coupling releasably coupling said faucet head to said faucet body, said magnetic coupling including a head connector supported by the faucet head, the head connector comprising one of a magnet and a magnetically attractive material, and a body connector comprising the other of the magnet and the magnetically attractive material, the body connector having an engagement surface engaging the internal surface of the faucet body and a protrusion, the engagement surface and the protrusion securing the body connector in the faucet body when the protrusion is received by the orifice.

11. The faucet of claim 10 wherein said magnetically attractive material includes iron, steel or mixture thereof.

12. The faucet of claim 10 wherein the magnetic coupling includes an attracting mode of operation and a repelling mode of operation.

13. The faucet of claim 1 wherein said head includes one of a female member and a male member and said body includes the other of said female member and said male member, said female member configured to mate with said male member.

14. The faucet of claim 10, wherein the engagement surface comprises a pressure ring.

15. The faucet of claim 10 wherein said magnetically attractive material comprises a second magnet.

16. The faucet of claim 15 wherein said magnet of each of said head connector and said body connector includes a single magnetic field oriented in the same direction such that said magnetic coupling exhibits a single mode attracting said head connector to said body connector.

17. The faucet of claim 15 wherein said magnet and said second magnet include multiple magnetic fields, at least two of said multiple magnetic fields are oriented in a first direction and the remaining of said multiple magnetic fields are arranged in a second direction, said second direction is substantially opposite said first direction such that, when said multiple magnetic fields of said magnet are oriented in the same direction as said multiple magnetic fields of said second magnet, said magnetic coupling exhibits an attracting mode of operation and, when said multiple magnetic fields of said magnet are oriented in a direction opposite said multiple magnetic fields of said second magnet, said magnetic coupling exhibits a repelling mode of operation.

18. The faucet of claim 15 wherein said head connector includes one of a female member and a male member and said body connector includes the other of said female member and said male member, said female member configured to mate with said male member.

19. The faucet of claim 10, wherein the orifice comprises a through-hole.

20. The faucet of claim 19, wherein the orifice comprises a slot.

21. The faucet of claim 10, wherein the orifice is axially displaced from the engagement surface when the protrusion is received by the orifice.

22. The faucet of claim 21, wherein the body connector includes a snap-finger comprising the protrusion.

23. A faucet for dispensing a fluid, the faucet comprising:

a fluid supply line;

a faucet head having a shell and an end connector fluidly coupled to the supply line to receive the fluid therefrom;

a faucet body having an arcuate wall with an internal surface which defines an axial passageway, the internal surface having a cavity; and a magnetic coupling releasably coupling said faucet head to said faucet body, said magnetic coupling including a head connector disposed on said faucet head and a body connector disposed on said internal surface of said faucet body, at least one of said head connector and said body connector having a first magnet and the other of said head connector and said body connector having a magnetically attractive member, said body connector including an engagement surface engaging said internal surface and a protruding portion configured to retain said body connector in said faucet body when said protruding portion is received by said cavity.

24. The faucet of claim 23 wherein said magnetically attractive member is formed of steel, iron or a mixture thereof.

25. The faucet of claim 23 wherein said first magnet includes a first magnetic field and said magnetically attractive member includes a second magnet having a second magnetic field oriented in the same direction as said first magnetic field.

26. The faucet of claim 23 wherein said magnetically attractive member includes a second magnet and each of said first magnet and said second magnet includes a single magnetic field oriented in the same direction such that said magnetic coupling exhibits a single mode attracting said head connector to said body connector.

27. The faucet of claim 23 wherein said magnetically attractive member includes said second magnet and each of said first magnet and said second magnet includes multiple magnetic fields, at least two of said multiple magnetic fields are oriented in a first direction and the remaining of said multiple magnetic fields are oriented in a second direction, and said first direction is substantially opposite said second direction such that said magnetic coupling is bimodal.

28. The faucet of claim 23 wherein said head connector includes one of a female member and a male member, and said body connector includes the other of said female member and said male member, said female member configured to mate with said male member.

29. The faucet of claim 23, wherein the engagement surface comprises a pressure ring.

30. The faucet of claim 23 wherein said first magnet includes a first magnetic field and said other of said head connector and said body connector further includes an electromagnet.

31. The faucet of claim 30 wherein said electromagnet is switchable between an energized state and a de-energized state, wherein in the energized state said electromagnet exhibits an electromagnetic field oriented in a direction opposite said first magnetic field of said magnet.

32. The faucet of claim 23, wherein the cavity comprises a through-hole.

33. The faucet of claim 32, wherein the cavity comprises a slot.

34. The faucet of claim 23, wherein the cavity is axially displaced from the engagement surface when the protruding portion is received by the cavity.

35. The faucet of claim 34, wherein the body connector includes a snap-finger comprising the protruding portion.

* * * * *